US011311762B2

(12) United States Patent
Andon

(10) Patent No.: US 11,311,762 B2
(45) Date of Patent: Apr. 26, 2022

(54) MODULAR PLAY SET

(71) Applicant: VULY IP HOLDINGS NO. 2 PTY LTD, Wakerley (AU)

(72) Inventor: Joe Andon, Wakerly (AU)

(73) Assignee: VULY IP HOLDINGS NO. 2 PTY LTD, Wakerley (AU)

( * ) Notice: Subject to any disclaimer, the term of this patent is extended or adjusted under 35 U.S.C. 154(b) by 561 days.

(21) Appl. No.: 16/301,401

(22) PCT Filed: May 18, 2017

(86) PCT No.: PCT/AU2017/050462
§ 371 (c)(1),
(2) Date: Nov. 13, 2018

(87) PCT Pub. No.: WO2017/197458
PCT Pub. Date: Nov. 23, 2017

(65) Prior Publication Data

US 2020/0376315 A1 Dec. 3, 2020

(30) Foreign Application Priority Data

May 18, 2016 (AU) ..... 2016901846
May 31, 2016 (AU) ..... 2016902075
(Continued)

(51) Int. Cl.
*A63B 17/04* (2006.01)
*A63B 9/00* (2006.01)
(Continued)

(52) U.S. Cl.
CPC ..... *A63B 17/04* (2013.01); *A63B 5/11* (2013.01); *A63B 9/00* (2013.01); *A63G 9/12* (2013.01);
(Continued)

(58) Field of Classification Search
CPC ..... A63B 9/00; A63B 2009/002–004
See application file for complete search history.

(56) References Cited

U.S. PATENT DOCUMENTS 2,954,977 A * 10/1960 Durlacher ..... A63B 9/00 482/36
3,850,428 A * 11/1974 Zuber ..... A63B 9/00 482/36
(Continued)

FOREIGN PATENT DOCUMENTS

FR 2562175 A1 10/1985
GB 2482319 A 2/2012
WO WO-2016039752 A1 * 3/2016 ..... A63B 17/02

OTHER PUBLICATIONS

International search report for counterpart PCT Application No. PCT/AU2017/050462.

*Primary Examiner* — Nyca T Nguyen
(74) *Attorney, Agent, or Firm* — Shaver & Swanson, LLP; Scott D. Swanson

(57) ABSTRACT

A modular play set including a support beam for supporting one or more play equipments therealong, two or more support assemblies each supporting an end of the support beam above a support surface, the support assemblies each including one or more upright poles having a lower end for engagement with the support surface and an upper end remote from the lower end, a lateral support structure engaging the upper end of each pole, the lateral support structure having a support beam connection for connecting to one end of one or more of the support beams and extending by a predetermined distance transverse to the or at least one of the support beams connected thereto. A play equipment may be a swing having a pivot assembly mounted to the frame for pivoting about a substantially horizontal fixed axis; a swivel assembly operatively associated with the
(Continued)

pivot assembly for pivoting about a swivel axis substantially orthogonal to the said fixed axis to pivot about the fixed axis; and a frame mounted to said swivel assembly for supporting a user, the frame having a platform spaced from the fixed axis a distance sufficient for a user to stand on the platform through which the swivel axis passes and a hanger portion operatively interposed between the platform and the swivel assembly and spaced from the swivel axis.

13 Claims, 7 Drawing Sheets

(30) Foreign Application Priority Data

Feb. 15, 2017 (AU) ..... 2017900478
Feb. 28, 2017 (AU) ..... 2017900679

(51) Int. Cl.
*A63G 9/12* (2006.01)
*A63B 71/02* (2006.01)
*A63B 5/11* (2006.01)
*E04H 15/02* (2006.01)

(52) U.S. Cl.
CPC ..... *E04H 15/02* (2013.01); *A63B 2009/006* (2013.01); *A63B 2071/024* (2013.01)

(56) References Cited

U.S. PATENT DOCUMENTS 4,431,183 A 2/1984 Reimann
4,796,884 A * 1/1989 Ely ..... A63B 9/00 482/35
4,898,198 A * 2/1990 Castlebury ..... A63G 9/00 135/117
5,147,247 A * 9/1992 Addleman ..... A63G 9/00 248/370
5,334,098 A * 8/1994 Pope ..... A63B 9/00 472/116
5,364,312 A * 11/1994 Cunard ..... A63G 9/00 182/153
5,417,027 A * 5/1995 Wagenet ..... A63B 9/00 446/125
5,620,396 A * 4/1997 Westphal ..... A63B 9/00 135/97
6,402,631 B1 * 6/2002 Gembarowicz ..... A63B 63/004 472/118
D483,429 S * 12/2003 Tseng ..... D21/823
7,235,019 B1 * 6/2007 LeCher ..... A63G 9/00 403/217
10,702,785 B1 * 7/2020 Chen ..... A63B 71/03
2006/0270525 A1 11/2006 Colling
2007/0078014 A1 4/2007 Nye et al.
2008/0282621 A1 * 11/2008 Chen ..... A63B 9/00 52/36.2
2009/0258759 A1 10/2009 Chen
2012/0142506 A1 * 6/2012 Hetrick ..... A63B 23/0216 482/142
2013/0337925 A1 12/2013 Hsu et al.
2015/0111655 A1 * 4/2015 Coleman ..... A63G 31/12 472/134
2015/0196119 A1 * 7/2015 Henniger ..... A63G 9/00 211/85.7
2015/0335932 A1 * 11/2015 Chen ..... A63B 9/00 482/36
2016/0346582 A1 * 12/2016 Wilkinson ..... A63B 47/00
2017/0326400 A1 * 11/2017 Brennan ..... A63B 71/0054
2018/0093135 A1 * 4/2018 Roberts ..... A63B 27/00
2018/0133606 A1 * 5/2018 Briggs ..... A63G 31/007
2019/0111295 A1 * 4/2019 Watson ..... A63B 71/023
2020/0101347 A1 * 4/2020 Valdez ..... A63B 21/4045

* cited by examiner

MODULAR PLAY SET

CROSS-REFERENCE TO RELATED APPLICATIONS

The present application is a U.S. National Stage Application under 35 U.S.C. § 371 of International Patent Application No. PCT/AU2017/050462, filed May 18, 2017, which claims priority from Australian Patent Application No. 2016901846, filed May 18, 2016, Australian Patent Application No. 2016902075, filed May 31, 2016, Australian Patent Application No. 2017900478, filed Feb. 15, 2017, and Australian Patent Application No. 2017900679, filed Feb. 28, 2017, the disclosures of all of which are incorporated in their entirety by reference for all purposes.

FIELD OF INVENTION

THIS INVENTION relates to a modular play set. The invention has particular application to a modular play set including 5 provision for mounting a range of play equipment such as swings, slides, climbing assemblies and such like and for illustrative purposes, reference will be made to such application. The modular play set according to the invention may have application for outdoor use, and also for indoor use, such as in gymnasiums or the like. The invention also has particular application to a swing for use in a modular play set.

BACKGROUND ART

Play sets for children have been provided, commonly being confined to a swing set, but sometimes having other play equipment attachable, such as slides, ladders or the like for climbing, slide poles and the like. Swing sets for back yard use are normally very cheaply produced and have a fixed arrangement, usually having a support beam supported by each end at or near the apex of an A-fame. More expensive play equipment is provided in public parks or commercial play areas, such equipment often being heavy and quite large and not necessarily efficient in use.

Swings are normally mounted to and suspended from a support bar of a frame, and are normally arranged to provide a predominantly forward and back swinging motion, sometimes being limited to such motion, but even when not so limited, having a design which is clearly intended that swing be set in motion about a fixed axis substantially aligned with the frame from 5 which the swing is suspended. Sometimes, when using a swing comprising a seat connected between the lower ends of two suspended chains or cables, a user may twist the seat around and around about an axis intermediate the chains or cables, but the swing is not necessarily designed for such use and such use is limited to twisting and untwisting the chains or cables and cannot be readily combined with a swinging motion.

The present invention aims to provide a modular play set and/or a swing which alleviates one or more of the above disadvantages or to provide an alternative to existing playsets or swings. Other aims and advantages of the present invention may become apparent from the following description.

With the foregoing objects in view, this invention in one aspect resides broadly in a modular play set including:

one or more support beams for supporting a plurality of play equipments therealong;

two or more support assemblies each supporting an end of the or each support beam above a support surface in a lateral attitude, the support assemblies each including one or more upright poles having a lower end for engagement with the support surface and an upper end remote from the lower end; a lateral support structure engaging the upper end of the or each pole, the lateral support structure having a support beam connection for connecting to one end of one or more of the support beams and extending by a predetermined distance transverse to the or at least one of the support beams connected thereto.

Suitably, the support beam includes attachment means for attaching swings or other play equipment. The swings may be selected from standard swings, boat swings, bucket swings, trapeze, tyre swings, glide swings, swivel swings, slings and such like. Other equipments may include rope ladders, scramble 15 nets, knotted ropes, climbing poles or ropes, roman rings, slides, platforms and such like. A cross beam may be provided between the upright poles of the support assemblies that have two or more upright poles.

Preferably, the support assemblies include means for connecting other play equipment which is not supported by the support beam, such as slides or slippery dips, nets, platforms and such like. In a preferred form, there is provided a flexible support assembly connectible to at least one of the support assemblies remote from the support beam. In such form, the flexible support assembly includes a sheet of flexible, substantially inextensible material such as trampoline mat material, held taut between two of the upright poles more preferably extending to at least two ground anchors remote from the lower ends of the support poles.

Preferably, the predetermined distance of the lateral support structure provides a wide support for a cover assembly to be mounted on or fastened to thereto. The cover assembly is preferably in the form of a tent or the like as a roof structure 10 or a roof with a tent wall assembly fastenable thereto. Preferably, a tent roof support band is provided wrapped around the external perimeter of two or more lateral support structures, thereby providing support for the peripheral edges of the tent roof between the support assemblies. The tent roof 15 band is preferably formed from substantially inextensible material.

The predetermined distance is preferably selected to provide cover for persons using the equipment, but not necessarily so wide as to cover the swings when they are swung 20 out from their rest position. However, where the tent wall assemblies are provided, they may be arranged such that they extend downwards from the periphery of the roof when the modular play set is not being used, but swung up to a horizontal or near-horizontal attitude when the modular play set is in use, thereby providing weather protection to users even when swinging on the swings.

The cover assembly may be arranged and/or sized to be fitted and/or fixed tightly to the lateral support structure, thereby 5 providing additional stiffness to the assembled frame against relative movement of the parts of the frame assembly.

In another aspect, this invention resides broadly in a swing suspended from a frame, including:

a pivot assembly mounted to the frame for pivoting about a substantially horizontal fixed axis;

a swivel assembly operatively associated with the pivot assembly for pivoting about a swivel axis substantially orthogonal to the said fixed axis whereby said swivel assembly may pivot about said fixed axis; and a frame for supporting a user mounted to said swivel assembly, said frame having a platform spaced from said fixed axis a distance sufficient for a user to stand on said platform, said platform being penetrated by said swivel axis and a hanger portion operatively interposed between said platform and said swivel assembly and spaced from said swivel axis.

Preferably, the frame includes one or more handles mounted to the hanger portion at a position suitable for a user to grip when standing on the platform. Preferably, the platform is an elongate platform sized for the user to stand with a foot at or near each end. Preferably, the hanger portion is constituted by a single frame member extending from the swivel assembly 5 laterally of the swivel axis, thence alongside the swivel axis, spaced therefrom as hereinbefore described, then towards and through the swivel axis for supporting the platform.

Preferably, the swing is suspended from a frame of a modular play set such as, for example, the modular play set according to the previous aspect of the present invention.

Suitably, the hanger portion is arranged so as to permit the user to stand on the platform with the swivel axis passing through the user's body, but also to move their body to move the centre of gravity with respect to the swivel axis to effect a 15 swinging motion about the fixed axis. Such movement may also be performed to cause rotation of the user about the swivel axis. With practice, a user may be able to cause swinging and rotation, much akin to orbiting the swivel axis.

In a preferred form, the platform has a shape akin to that of a skate board or small surfboard. The platform, being in its preferred form elongate, has a platform axis in the direction of elongation. When the swing is swinging with the platform, the user may swivel the platform such that the elongate axis of the platform is substantially aligned with the direction of swinging about the fixed axis. However, the user may swing with the elongate axis of the platform out of alignment with the direction of swinging at any angle desired, and with practice, as described above, effect a swinging motion in combination with a rotational motion about the swivel axis. Such use may also be with the rotation substantially inconstant.

BRIEF DESCRIPTION OF THE DRAWINGS

In order that this invention may be more readily understood and put into practical effect, reference will now be made to the 10 following drawings which illustrate several preferred embodiments or forms of the invention, and wherein.

DESCRIPTION OF EMBODIMENTS

Figure 1:
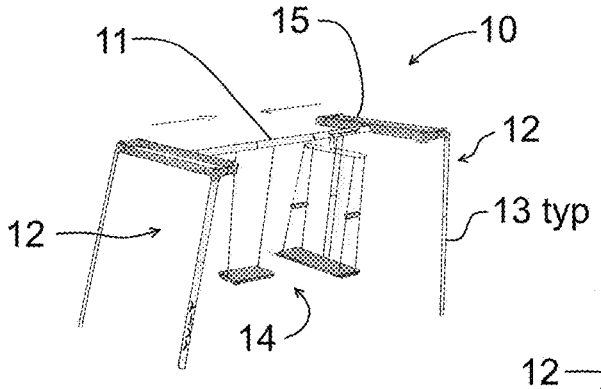
FIG. 1 is a pictorial view of a modular play set according to the invention according to a preferred form.

The modular play set 10 illustrated in FIGS. 1 to 5 includes a support beam 11 supported at each end by a support assembly 12 having two support poles shown typically at 13. The support beam has two play equipments 14 attached intermediate its ends. The play equipments shown are a normal swing having a seat supported by a chain and a glide swing having a board suspended by two rods or chains from a support bar which is attached to the support beam to extend transversely thereto.

The support assembly includes a rectangular support frame 15, the rectangular support frame being elongate in the 5 direction transverse to the support beam, the support poles extending downward from two corners, for convenience referred to as outer corners, and the support beam being attached to the side of the rectangular support frame opposite, for convenience referred to as the inner side. The support beam may extend to 10 the outer side of the rectangular support frame to support heavier weights if required.

Figure 2:
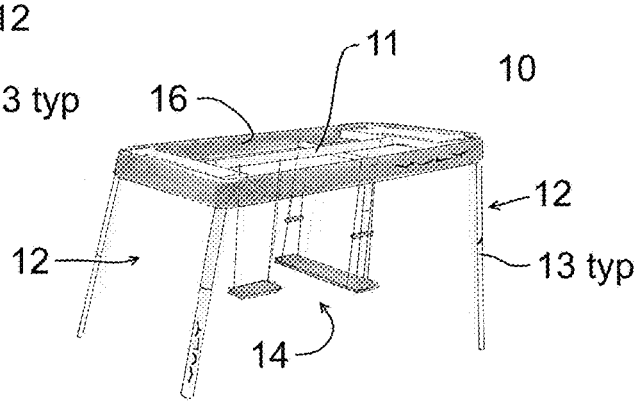
FIG. 2 is a pictorial view of the modular play set of FIG. 1 to which a support band has been added.

The support band 16 shown in FIG. 2 surrounds the two support frames at each end of the play set, extending parallel to the support beam between the ends of the support frames. The 15 support band thus also is of rectangular form and encloses a space which is substantially rectangular in plan view, the rectangular space containing within it the support beam and the two rectangular support frames, and extending downward from the top of the play set a short distance akin to a skirt.

Figure 3:
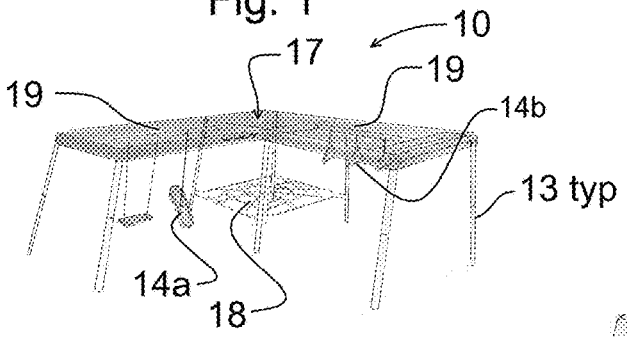
FIG. 3 is a pictorial view of the modular play set of FIG. 2 to which additional modular elements have been attached.

The modular play set illustrated in FIG. 3 has a swivel swing 14*a* instead of the glide swing, and has added to it a corner support assembly 17 having a scramble net 18 and triangular acrobatic grips 14*b* suspended from another support beam extending from the side of the corner support assembly adjacent the support beam to which the swings are attached. A tent roof cover 19 is fastened to the support band to provide covering and protection from the weather for the users and the play equipments supported by the support beam.

Figure 4:
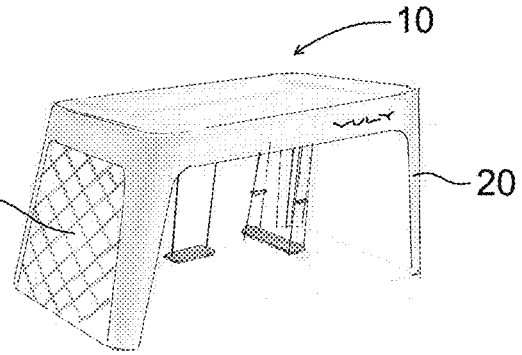
FIG. 4 is a pictorial view of the modular play set of FIG. 2 to which a tent assembly has been secured.

The modular play set illustrated in FIG. 4 also has four corner side wall panels shown typically at 20 around the outside parts of the support poles, extending downward from the top to the base. A netting wall 21 extends across the opening of one end of the tent assembly as shown. The covering or tent assembly 10 is made up from separate covering elements which can be joined to and detached from one another, the covering elements being modularised to provide a covering for different configurations of modular play set for which covering is provided. Side panels may be selected from ones with windows and ones without, the 15 elements forming the side walls having provision for being held against the outside of the support band when rolled up from the bottom.

Figure 5:
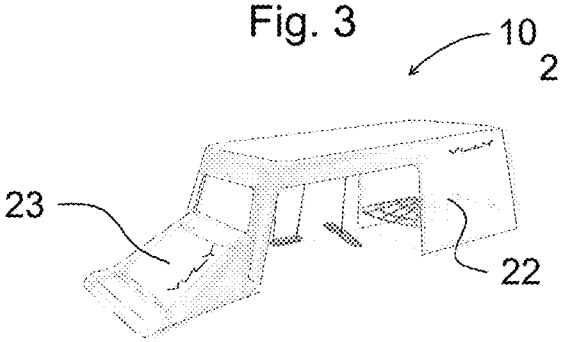
FIG. 5 is a pictorial view of the modular play set of FIG. 2 to which a further modular element has been added and a tent assembly has been secured.

The modular feature of the play set is further illustrated in FIG. 5 which shows the scramble net for the corner assembly 20 being enclosed by side walls 22 without the extra support beam for the athletic triangles shown in FIG. 3. It will be seen that the modular play set according to the invention may be provided in different configurations and with a covering which can be opened up for use and closed up for storage when not in use.

The alternative modular play set 30 according to the invention has a support beam assembly 31 extending between two alternative support assemblies 32, the support beam assembly having two parallel support styles 33 connected in spaced 5 disposition from one another by a plurality of rungs shown typically at 34 in a ladder-like construction. Shorter ladderlike constructions may be joined end-to-end by two joiners 35 operatively associated with the ends or end portions of the support styles.

The alternative support assemblies each have two support poles as hereinbefore described, but also each include a cross beam 37 and a side panel 38 parallel to and below the cross beam, the cross beam and side panel being substantially evenly spaced from one another and the top and bottom of the support poles.

The support poles may include a join intermediate their ends so that the play set can be packaged in a smaller sized carton that would be the case for integral support poles. The support poles are joined by an H-shaped joiner 39, the cross-bar of the H providing rigidity to the side panels and the end bars of the joiner providing for attachment of the side panel, such as by a wrap-around interference fit.

Figure 6:
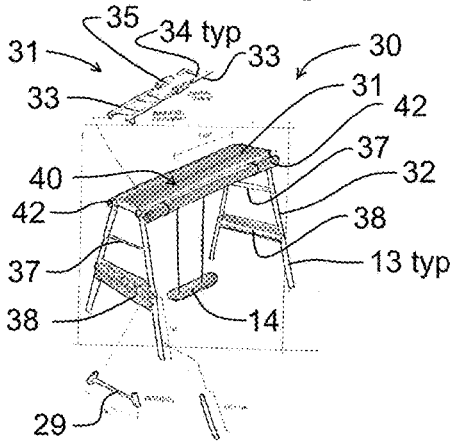
FIG. 6 is pictorial view of an alternative preferred form of modular play set according to the invention with a cover assembly in a furled disposition.
Figure 7:
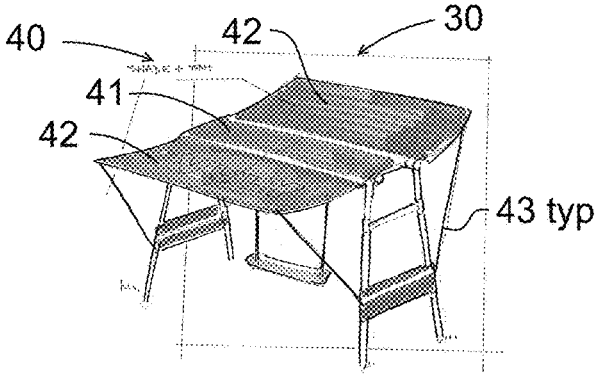
FIG. 7 is a pictorial view of the modular play set of FIG. 6 with the cover assembly deployed.
Figure 8:
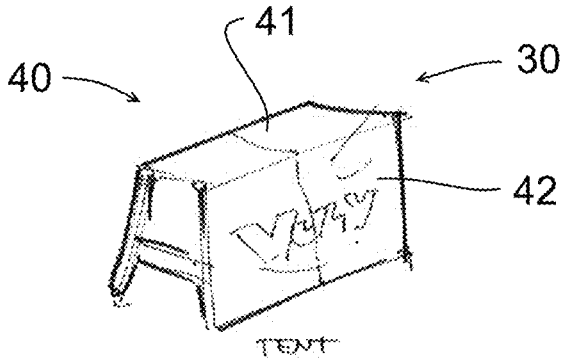
FIG. 8 is a pictorial view of the modular play set of FIG. 6 with the cover assembly closed.

The alternative modular play set has a cover assembly 40 having a roof panel portion 41 and two side panel portions 42, being rolled up or furled in the illustration shown in FIG. 6 and deployed outwardly in the illustration shown in FIG. 7. The side panel portions are each held in place by two struts shown typically at 43 which extend upward from the alternative support assemblies at about the level of the side panels to an end edge of the respective side panel. The side panel portions may be folded down to a closed disposition as in the illustration shown in FIG. 8.

Figure 9:
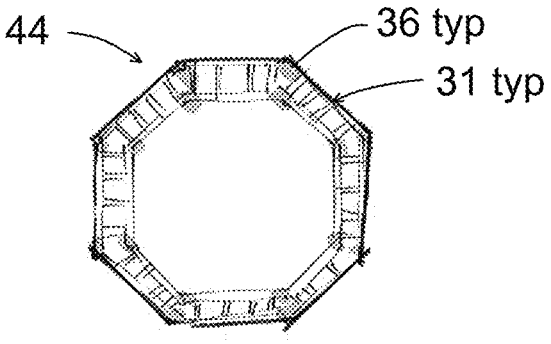
FIG. 9 is a diagrammatic plan view of a support beam assembly for eight modular play sets of FIG. 6 joined into 10 an octagonal arrangement.
Figure 10:
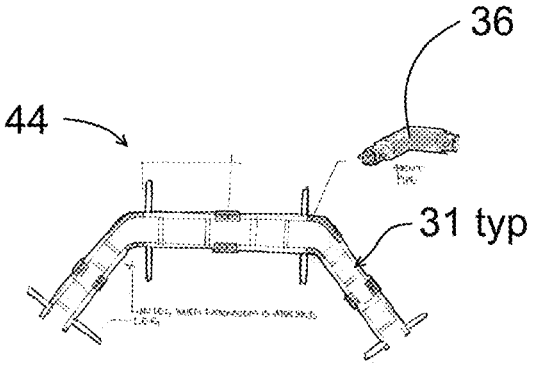
FIG. 10 is a diagrammatic plan view of part of the support beam assembly of FIG. 9.
Figure 11:
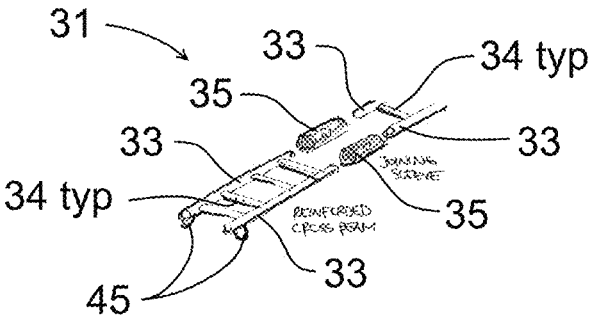
FIG. 11 is an exploded view of part of the support beam assembly of FIG. 9.

The support beam assemblies shown in FIGS. 9 and 10 are joined end-to-end to one another by a commensurate number of corner joiners shown typically at 36. There are eight support beam assemblies formed into an octagon or octagonal ring 44 as shown in complete form in FIG. 9 and in part in more detail in FIG. 10. The support beam assembly is shown in more detail in FIG. 11 having the parallel support styles connected by the rungs as hereinbefore described in respect of FIG. 6, but the additional detail shows a connecting spigot or socket 45 at or near the end of the support styles each for engagement with the upper end of a support pole.

Figure 12:
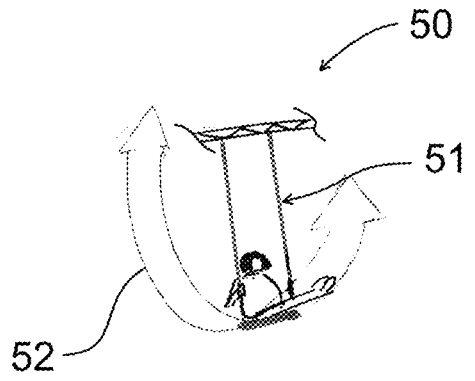
FIGS. 12 to 15 illustrate alternative swing arrangements for the modular play sets of FIGS. 1 to 5.
Figure 13:
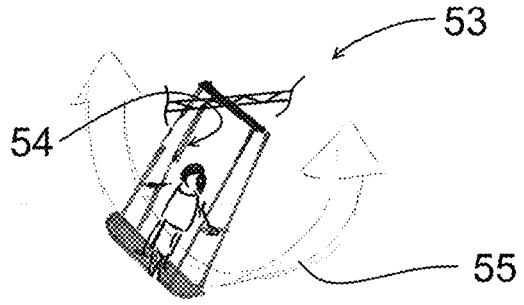
Figure 14:
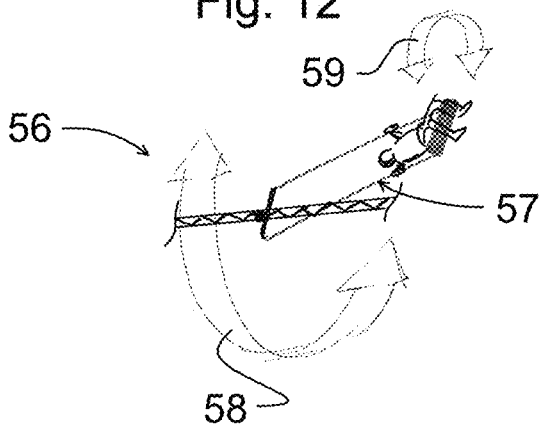
Figure 15:
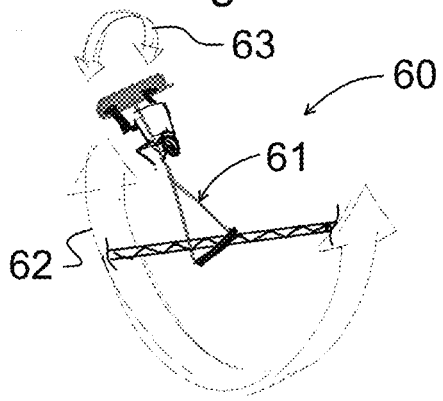
Figure 16:
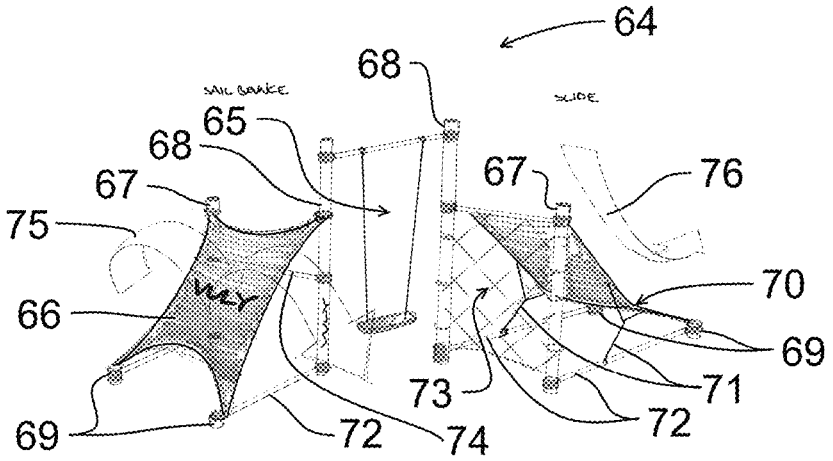
FIG. 16 illustrates further play equipments for the modular play sets of FIGS. 1 to 8.

The swing arrangements illustrated in FIGS. 12 to 15 are illustrated as attached to a standard support frame as hereinbefore described. The swing arrangement 50 illustrated in FIG. 12 is a standard swing 51 which may be swung back and forth in the direction of arrow 52 with the user seated. The swing arrangement 53 illustrated in FIG. 13 is a surfboard swing 54 which may be swung back and forth in the direction of arrow 55 with the user standing. The swing arrangement 56 illustrated in FIG. 14 is a swivel swing 57 which may be swung back and forth in the direction of arrow 58 and swivelled around and around in either direction as indicated by arrow 59. The swing arrangement 60 illustrated in FIG. 15 is a standard swing 61 which may be swung back and forth in the direction of arrow 62 and swivelled around and around in either direction as indicated by arrow 63. 10 The further play equipments 64 illustrated in FIG. 16 include a standard swing 65 suspended from a support beam which in turn is supported above the ground by two support poles 68. The two support poles for the standard swing are supplemented by two other support poles 67 which can be of the kind 15 hereinbefore described with reference to FIGS. 1 to 8, being spaced from the support poles for the swing by the same spacing as that of the support poles for the support frame assembly. A bouncing mat 66 is stretched between one of the support poles and one of the other support poles, being attached at an elevated 20 position on the support poles, and further stretched between to ground anchors 69, being attached thereto at a lower position such that the bouncing mat or sail is at an oblique angle.

A slide mat 70 is attached to the other two support poles 67 and 68 at an elevated position and sloping downward therefrom to two further ground anchors. Each side edge of the slide mat is pulled downwards by a Y-shaped stay 71, two arms of the Y being attached to the respective side edge and the tail of the Y being attached to a lateral stay 72. The lateral stays are also provided between the support poles and ground anchors of the bouncing sail. A climbing net 73 is stretched between the support poles of the slide mat and a support strut 74 is provided between the support poles of the bouncing mat. A user may bounce on the bounce mat, such as, but not limited to, the direction 10 indicated by arrow 75, and may slide down the slide may in the direction of arrow 76.

Figure 17:
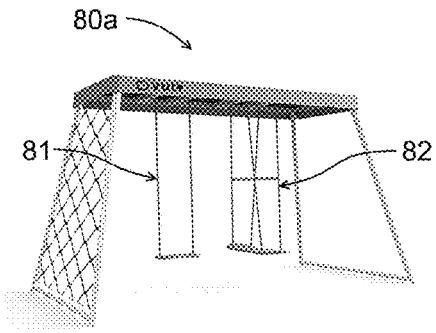
FIGS. 17 to 22 are illustrative of combinations of modular play elements being selected for assembly of some modular play sets in accordance with the invention.

The modular play sets 80*a* to 80*d* shown in FIGS. 17 to 22 provide illustrative examples of various ways in which different play elements may be provided. Taking FIGS. 17 to 19 in order, a swing 81 and a parallel swing 82 are shown in FIG. 17 supported on the frame, the "main frame 83", the main frame itself being hidden from view by the roof or cover, and in FIG. 18, a play area 84 and platform 85 are added, one of the truncated A-frame ends 12 being substituted by a corner module 86, and then a 20 slide 87 being added to extend at right angles to the main frame. And then in FIG. 19, the slide is moved to the side of the corner module extending from the main frame and a roof module or "side frame 88" is added to the corner module to extend at right angles to the main frame where the slide had previously been, the side frame being supported at its distal end by another truncated Aframe. A skate-board swing or surfboard swing 89 is added supported from the side frame.

The surfboard swing substantially takes the form of a rope swing which is suspended from the support beam of the side frame, having two upper ropes 81*b* suspended from the main beam, the upper ropes being joined at their lower ends to a single rope 81*c* which depends downward. A plank 81*d* is connected to the single rope substantially at its centre. A user sitting or 10 standing on the plank astride the single rope can swing back and forwards about the axis of, or substantially parallel to, that of the support beam, but also, from the lower ends of the upper ropes, laterally thereto, and also with a swivelling if desired.

Figure 18:
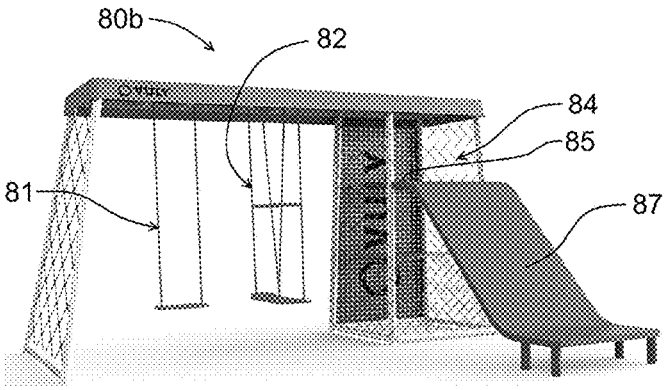
Figure 19:
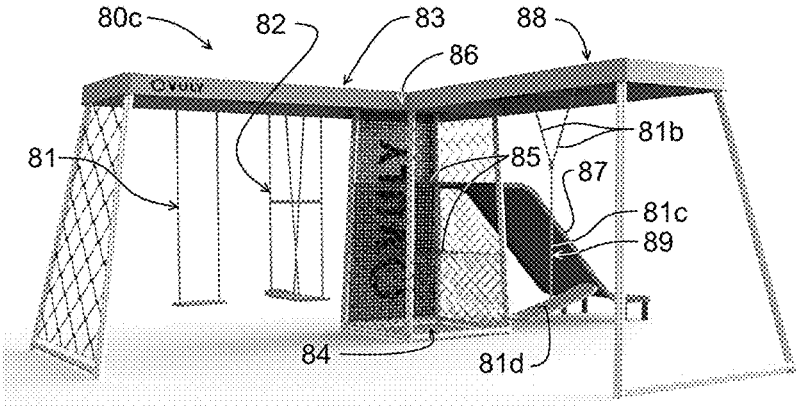
Figure 20:
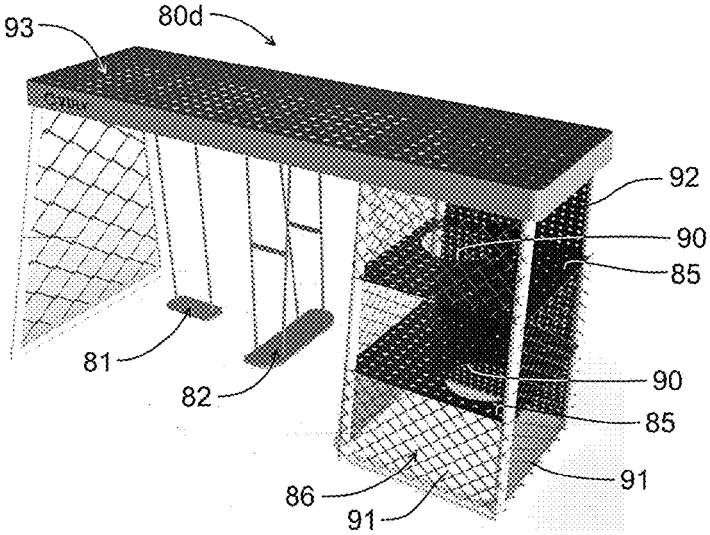
Figure 21:
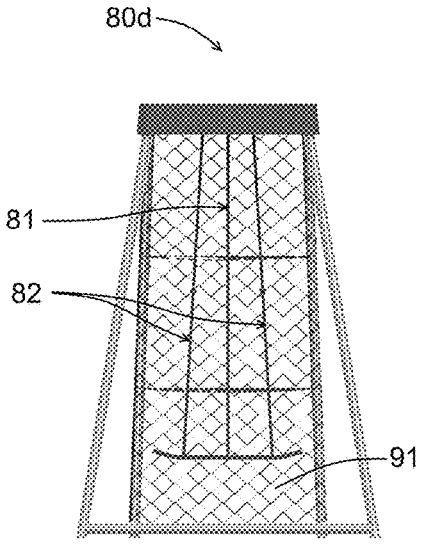
Figure 22:
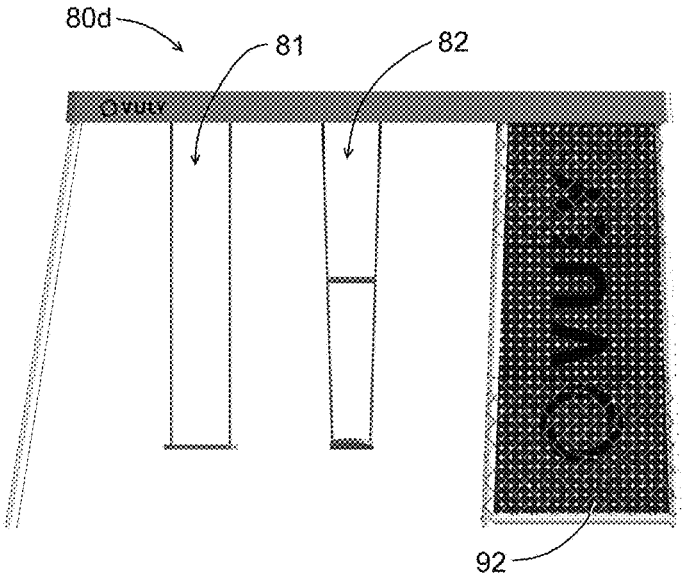

The modular play set 80*d* illustrated in FIGS. 20 to 22 shows more detail of the platforms 85 shown in FIGS. 18 and 19, each one having an aperture 90 sized for a user to climb through from below and each side of the corner module being enclosed or partly enclosed by netting 91 or perforated sheet 92, there being two platforms as illustrated. In this respect, one side 20 is completely enclosed by perforated sheet, two opposed sides are completely enclosed by netting and the fourth side opposite the perforated sheet has a lower panel enclosing the space between the floor or ground and the lower platform, and opening opposite the perforated sheet between the lower platform and the upper platform, and netting enclosing the space between the upper platform and the roof 93.

Figure 23:
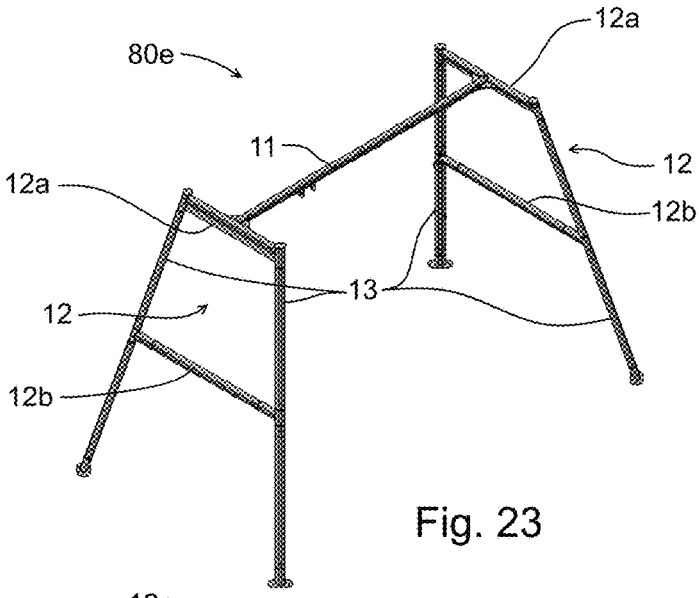
FIG. 23 is a pictorial view of a frame for the modular play set according to the invention.
Figure 24:
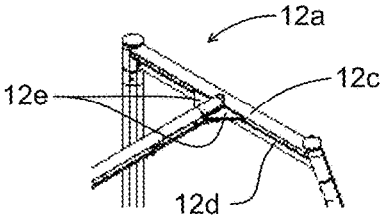
FIG. 24 is a detail pictorial view showing the connection detail between parts of the frame of FIG. 23.
Figure 25:
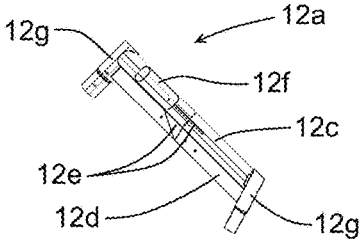
FIG. 25 is pictorial view showing a cross bar for the connection detail of FIG. 24

The modular play set 80*e* illustrated in FIGS. 23 to 27 has a main support beam 11 supported by two end frame support 5 assemblies 12 as shown in FIG. 23 in much the same form as that described above with reference to FIGS. 1 to 22. The support assemblies are in the form of a truncated A-frame, having a top bar 12*a* between the upper ends of the support poles and a central bar 12*b* intermediate the upper and lower ends of the support 10 poles. Referring to the detail views in FIGS. 24 and 25, the top bar has a bar portion 12*c* which is strengthened or stiffened by a plate portion 12*d* along the lower extremity and attached thereto such as by welding. Three strut plates 12*e* are provided intermediate the ends of the top bar, to secure, or more securely 15 attach, a spigot 12*f* or socket at right angles thereto for attachment of the main support beam. Similarly, end spigots or sockets 12*g* are attached to each end of the top bar for attachment of the support poles.

Figure 26:
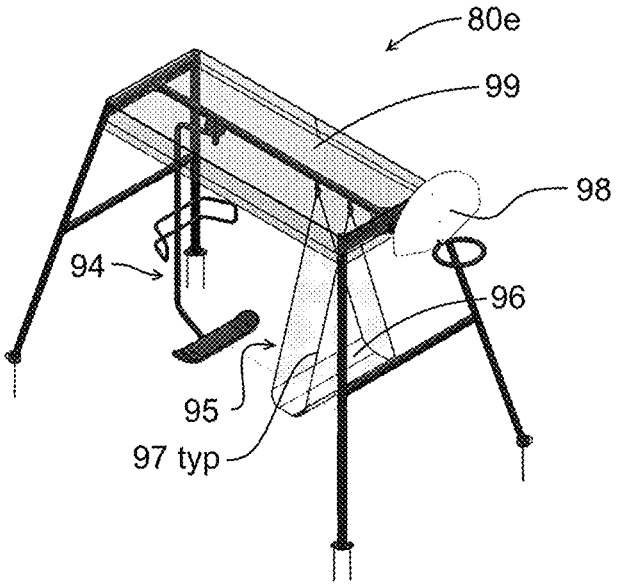
FIG. 26 pictorial view of the frame of FIG. 23 showing a sling and swivel swing connected thereto.
Figure 27:
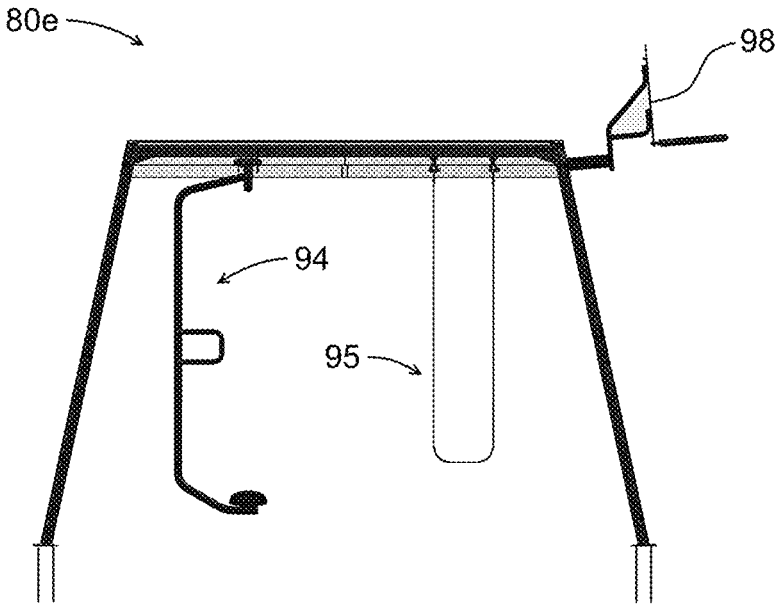
FIG. 27 is a front elevation of the frame of FIG. 26.
Figure 28:
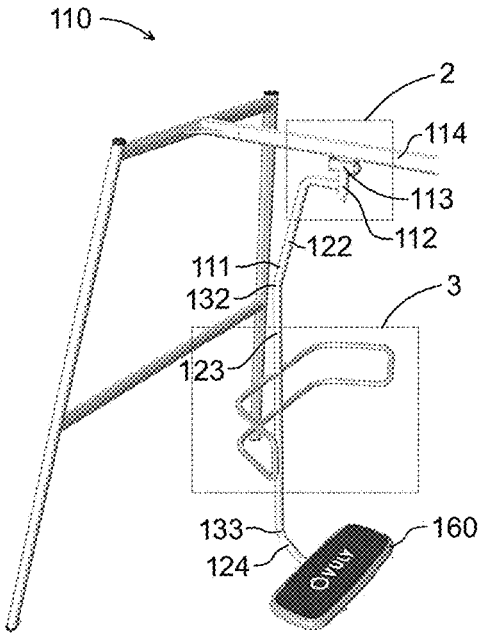
FIG. 28 is a pictorial view of a swing according to the invention.
Figure 29:
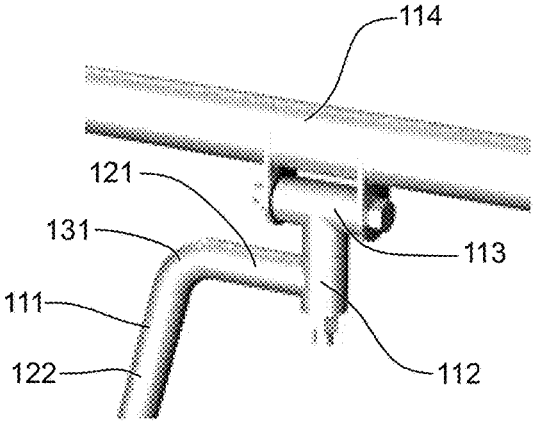
FIG. 29 is a pictorial view showing detail 2 of the swing of FIG. 28.
Figure 30:
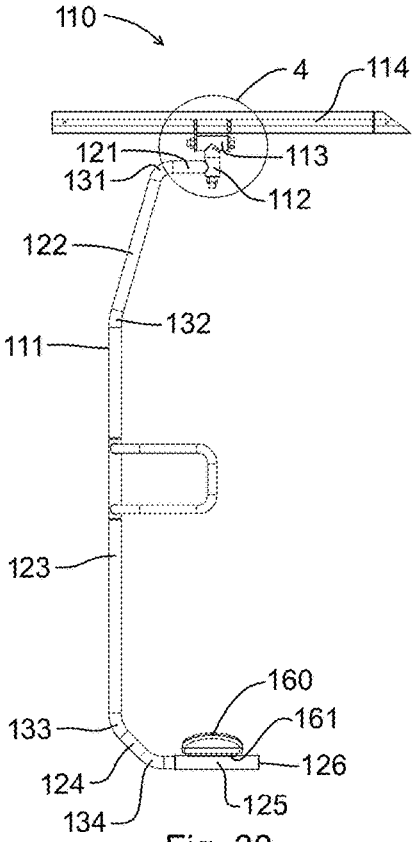
FIG. 30 is a front elevation of the swing of FIG. 28.
Figure 31:
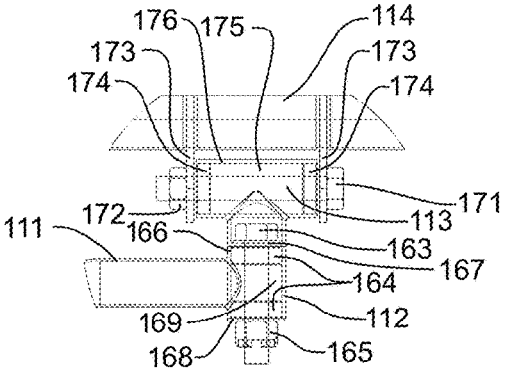
FIG. 31 is a front elevation showing detail 4 of the swing of FIG. 30.
Figure 32:
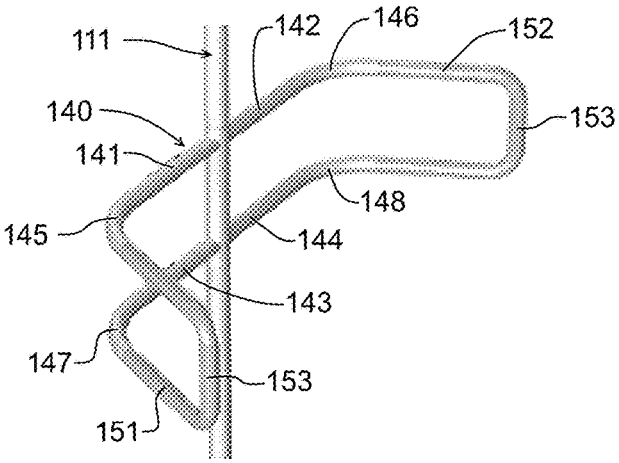
FIG. 32 is a pictorial view showing detail 3 of the swing of FIG. 28.

A swivel swing 94 and a sling swing 95 are each mounted to 20 the main support beam as shown in FIGS. 26 and 27. The sling swing has a U-section base 96 suspended by four cables shown typically at 97, the cables each extending from one of two pivots to a corner of the base. The base may be rigid but preferably, flexible with stiffening rods along the longer sides, such that its performance is much the same as that of a sling. Looking end on to the frame, the cables of the sling swing conform substantially to the sloping sides of a triangle, the base of which is provided substantially by at least part of the base and 5 the apex being substantially at the point where they are mounted to a pivot which in turn is mounted to the support beam. It can be seen that there are two pairs of cables in such arrangement, one pair supporting one side of the base and the other pair supporting the other side of the base.

Looking side on to the frame, and therefore end on to the sling swing, the cables appear substantially parallel, the distance between the sides of the base being substantially the same as the spacing between the pivot mounts supporting the sling swing. Additionally, a basketball hoop and backing board 98 are mounted to one of the truncated A-frames at the end of the frame. Fixing pegs are also shown diagrammatically as if they were extending into the ground to secure the frame against movement and/or tipping.

The combinations of modular play elements selected for assembly of the modular play sets in accordance with the invention include a mesh shade cover 99 though which water can drain. A rainproof cover may be placed over the mesh or substituted therefor. The support band may be branded or have other indicia thereon. Rope mesh may be stretched between the end poles, working well for climbing as well as for aesthetics, as shown in the previous drawings. A multilevel climbing tower also as previously illustrated, along with slides, safety nets, swivel swing and mesh panel (the same material as the mesh roof panel) may be provided, taking advantage of the modular nature of the design. The climbing tower may be provided to a higher level than that illustrated if desired.

The swing 110 illustrated in FIGS. 28 to 31 has a frame member 111 mounted to a swivel assembly 112 which is mounted to 10*a* pivot assembly 113 which is mounted to a support frame 114. The frame member is formed from a hollow section or pipe having a circular cross section and bent into a series of straight portions as follows. Taken from the swivel assembly and proceeding along the frame member, a transverse upper portion 121 extends laterally from the swivel assembly to a first bend 131, and then an upper oblique portion 122 extends from the first bend at an oblique angle to a second bend 132.

A main portion 123 of the frame member extends from the second bend substantially at right angles to the support frame, 20 the first and second bends being both have an obtuse internal angle, but when combined provide a bend between the transverse upper portion to the main portion of substantially 90°. The main frame member extends from the second bend to a third bend 133.

A lower oblique portion 124 extends from the third bend at an oblique angle to a fourth bend 134. A transverse lower portion 125 extends from the fourth bend to terminate at 126.

The third and fourth bends are substantially equal such that the transverse lower portion is at substantially 45°. That 5 is to say, each bend is substantially 45° to provide an included angle of substantially 135°, thereby providing that the lower transverse portion is substantially parallel to the upper transverse portion which is in turn substantially parallel to the support frame 114. The first angle is at about 73° to 74° 10 to provide an internal angle of about 106° to 107°. The second angle is the straight line complement of the first angle, being 16° to 17° to provide an internal angle of 163° to 164°.

A handle assembly 140 is mounted to the frame member about midway along the intermediate portion. The handle assembly is essentially a rectangular frame with its ends bent to substantially 90° from the main plane of the rectangle. In order to provide this form, the handle assembly has two upper lateral handle portions 141 and 142 and two lower lateral handle portions 143 and 144. The lateral handle portions 141 and 143 extend 20 nominally from the left of the frame member and the lateral handle portions 142 and 144 extend nominally to the right of the frame member. There are four handle bends 145, 146, 147 and 148. For discrimination purposes, they may be referred to as the upper left handle bend 145, the upper right handle bend 146, lower left handle bend 147 and lower right handle bend 148. Two gripping portions are provided, a left gripping portion 151 and a right gripping portion 152. Each gripping portion is in the form of a square "U" with rounded corners, each ending in a straight upright gripping portion 153.

A platform assembly 160 is mounted atop the transverse lower portion 125 having a board fastened to an adjustment plate 161 having a tubular portion which fits over the transverse lower portion of the frame member. The platform assembly is 10 adjusted so that its position is directly below the swivel, that is, with the swivel axis passing substantially centrally therethrough, and also oriented so that it is substantially level when the main part is substantially vertical.

The swivel assembly 112 has a swivel axle 163 in the form of a bolt penetrating two axially spaced swivel bearings 164 and secured in place by a nut, called hereinafter the swivel nut 165. The swivel axle is retained inside a tubular swivel housing 166 to which the upper portion 121 of the frame member is welded. The swivel bearings are retained in position axially by an upper bearing plate 167, a lower bearing plate 168 and a swivel bushing 169.

The pivot assembly 113 has a substantially horizontal pivot axle 171, alike to the swivel axle, in the form of a bolt secured in place by a nut, hereinafter called the pivot nut 172. The pivot axle passes through the bore of two hanger plates 173 welded to the support frame, and two pivot bearings 174 in between the hanger plates. The pivot bearings are held axially in place by a pivot bushing 175 and the hanger plates. A pivot housing 176 is free to rotate about the axis of the pivot axis, the swivel housing being welded thereto to extend radially from the pivot axis. The pivot and swivel axes intersect one another substantially at right angles, but it will be appreciated that the swing would still function similarly if the axes were offset from one another.

In use, the swing of the present invention may be mounted to a swing set along with other swing or play equipment. A user may mount the platform to stand upon same, and use their forward momentum, if any, to commence swinging the swing in an 15 oscillatory fashion about the pivot axis, much in the same way as one would for a traditional swing. However, being in a standing position, the user will be required to hang on to either the frame member or the handles. Swinging can be achieved in the normal manner, such as by shifting body weight with the swinging 20 of the swing. A swivelling motion may also be introduced by corresponding weight shifts of the user.

If desired, a motion akin to surfing or skateboarding may be achieved by adopting the appropriate stance on the platform. The user's feet may be orientated across the platform, along the platform, or any combination or orientation therebetween. The handles may be used for shifting the upper body away from the swivel axis to induce or otherwise control the swivelling of the swing about the swivel axis.

In use, a particular design of modular play set according to the present invention may be selected from optional elements according to the desires or requirements of a used. Once selected, the pieces are put together, possibly in the form of a kit. The design of the modular play set may be added to or 10 changed as required or desired, particularly where the user has a family with children advancing and developing as they grow.

The arrangement and design of the elements permits a lighter weight construction less expensive than play equipment as may be supplied to municipal parks or commercial child care centres.

It will be realised that the above is illustrative of one or more examples of the invention, and that all such modifications and variations thereto as would be apparent to persons skilled in the art are deemed to fall within the broad scope and ambit of the invention as herein set forth.

I claim:

1. A modular play set including:

one or more support beams for supporting a plurality of play equipment therealong;

two or more support assemblies each supporting at least an end of the or each support beam above a support surface in a lateral attitude;

the support assemblies each including one or more upright poles having a lower end for engagement with the support surface and an upper end remote from the lower end;

the support assemblies each including a rectangular support frame associated with each support assembly and engaging the upper end of one or more of said one or more upright poles at an outer side of said rectangular support frame, the rectangular support frame having a support beam connection on an inner side of the rectangular support frame for connecting to one end of one or more of the support beams, the inner side of the rectangular support frame being opposite to the outer side of the rectangular support frame and parallel to the outer side of the rectangular support frame, said rectangular support frame having an elongate length in a direction transverse to the or at least one of the support beams connected thereto such that said inner side of the rectangular support frame and the outer side of the elongate support frame are positioned transverse to the one or more support beams when said one or more support beams are connected to said inner side of the rectangular support frame, wherein said rectangular support frame comprising two opposing sides forming a width of said rectangular support frame, wherein said two opposing side forming said width of said rectangular support frame extend parallel to said one or more support beams; and a cover assembly, wherein the rectangular support frames are adapted to provide support for the cover assembly so that, in use, the cover assembly provides cover to the plurality of play equipment;

wherein the cover assembly comprises a support band wrapped around at least a part of an external perimeter of the modular play set.

2. The modular play set according to claim 1, wherein the rectangular support frame provides a wide support for the cover assembly to be mounted on or fastened to thereto, the cover assembly including the support band formed from a substantially inextensible material.

3. The modular play set according to claim 2, wherein the inextensible material is wrapped around the external perimeter of two or more of the rectangular support frames.

4. The modular play set according to claim 2 wherein the cover assembly is sized as a tight fit to the rectangular support frames, thereby providing additional stiffness to an assembled frame of the modular play set against relative movement of the parts of the assembled frame.

5. The modular play set according to claim 1, wherein there are three or more support assemblies.

6. The modular play set according to claim 5, wherein the support assemblies are adapted to be joined end-to-end by joiners.

7. The modular play set according to claim 1, wherein there is further provided a flexible support assembly formed from trampoline mat material connectible to at least one of the support assemblies remote from the support beam.

8. The modular play set according to claim 7, wherein the flexible support assembly includes a sheet of flexible, substantially inextensible material held taut between two of the upright poles.

9. The modular play set according to claim 8, wherein the substantially inextensible material extends to at least two ground anchors remote from the lower ends of the support poles.

10. The modular play set according to claim 1, wherein there is only one support beam, wherein the support beam connects to the inside of the upper rectangular support frame connected to two of the support assemblies.

11. The modular play set according to claim 10, wherein there is at least a second support beam, wherein the second support beam connects to the outside of the upper rectangular support frames and is further connected to a third upper rectangular support frame, wherein the third upper rectangular support frame is connected to a third support assembly.

12. The modular play set according to claim 1, wherein the support band is an integral part of the cover assembly and encloses a space forming between the rectangular support frames located at each of the support assemblies which is substantially rectangular in plan view, the rectangular enclosed space containing within it the support beam and the support band extends downward from the top of the play set a short distance akin to a skirt.

13. The modular play set according to claim 1, wherein said one or more support beams are configured for connecting swings or other play equipment, wherein the swings are selected from one of a standard swings, boat swings, bucket swings, trapeze, tyre swings, glide swings, swivel swings and slings; and wherein the other play equipment includes one or more of slides, slippery dips, rope ladders, scramble nets, knotted ropes, climbing poles or ropes, roman rings, slides and/or platforms.

* * * * *